US006601891B1

(12) United States Patent
Gregory, Jr.

(10) Patent No.: US 6,601,891 B1
(45) Date of Patent: Aug. 5, 2003

(54) GRAPPLE ATTACHMENT

(76) Inventor: Warren D. Gregory, Jr., P.O. Box 342, Sydney, IA (US) 51652-0342

( * ) Notice: Subject to any disclaimer, the term of this patent is extended or adjusted under 35 U.S.C. 154(b) by 0 days.

(21) Appl. No.: 09/864,495

(22) Filed: May 24, 2001

(51) Int. Cl.[7] ..... B66C 3/04
(52) U.S. Cl. ..... 294/88; 294/104; 414/740
(58) Field of Search ..... 294/86.4, 88, 104, 294/105, 106, 107; 414/732, 738, 739, 740

(56) References Cited

U.S. PATENT DOCUMENTS

| | | | | | |
|---|---|---|---|---|---|
| 2,776,768 | A | * | 1/1957 | Carlson | 285/908 |
| 2,908,409 | A | * | 10/1959 | Hinders et al. | 294/104 |
| 3,073,645 | A | * | 1/1963 | Behrens | 294/88 |
| 3,152,706 | A | * | 10/1964 | Conrad | 294/104 |
| 3,165,347 | A | * | 1/1965 | Keskitalo | 294/104 |
| 3,275,173 | A | * | 9/1966 | Kampert et al. | 414/704 |
| 3,455,477 | A | * | 7/1969 | Blair | 414/704 |
| 4,266,819 | A | * | 5/1981 | Pemberton | 294/88 |
| 4,382,625 | A | | 5/1983 | LaBounty | 294/104 |
| 4,529,239 | A | | 7/1985 | Ogawa | 294/88 |
| 4,641,439 | A | * | 2/1987 | Shirek | 37/303 |
| 4,818,005 | A | | 4/1989 | Purser | 294/88 |
| 5,150,936 | A | | 9/1992 | Avery | 294/104 |
| 5,518,359 | A | * | 5/1996 | Pratt | 37/406 |
| 6,098,320 | A | | 8/2000 | Wass | 37/406 |
| 6,176,531 | B1 | | 1/2001 | Wheeler | 294/88 |
| 6,267,547 | B1 | * | 7/2001 | Lund | 294/68.1 |

* cited by examiner

*Primary Examiner*—Dean J. Kramer
(74) *Attorney, Agent, or Firm*—Thomte, Mazour & Niebergall; Shane M. Niebergall

(57) ABSTRACT

A grapple attachment is presented for use with motorized vehicles. The grapple attachment is comprised of upper and lower jaws having a plurality of elongated, substantially angular tines that are adapted for dislodging, lifting and carrying whole concrete slabs, vertically disposed posts, horizontally disposed logs, rocks and other awkward debris. The tines are further adapted for use in scarifying and ripping ground surfaces. The upper and lower jaws are pivotally connected to each other at the rearward ends thereof, thus forming the body of the grapple. A single actuator moves the grapple jaws between open and closed positions. The grapple is pivotally connected to the front-end loader using a universal hitch that is adapted for use on a plurality of motorized vehicles, including front-end loaders, skid loaders, tractors, backhoes, excavators and end loaders. The grapple can be easily formed by cutting each of the component parts from a single piece of high-strength steel plate and securing the parts through welding or other available attachment method. The efficient design of the present grapple makes it durable, inexpensive and easy to operate.

12 Claims, 3 Drawing Sheets

GRAPPLE ATTACHMENT

BACKGROUND OF THE INVENTION

1. Field of the Invention

The present invention relates to mechanical attachments for front-end loaders and other similar vehicles. More particularly, the present invention relates to a grapple attachment comprising upper and lower jaws having a plurality of tines that are adapted for dislodging, lifting and carrying concrete slabs, logs, rocks and other debris.

2. Description of the Prior Art

It has become a standard to use front-end loaders in construction and agricultural operations. The typical front-end loader consists of a large bucket mounted on, and extending transversely to, the front of a tractor. The bucket can be used to collect and transport several different types of materials such as dirt, stones and loose material. Although bucket-style attachments assist in accomplishing a wide range of material handling tasks, their use is nevertheless limited. For example, such attachments can be awkward, if not completely ineffective, when the operator needs to lift and carry large objects such as brush, logs and large sections of concrete. Moreover, the design of the bucket-style of attachment is inefficient for piercing and breaking through solid ground cover commonly found in construction projects, including asphalt and concrete.

Several manufacturers in the art, such as John Deere and Kubota, have attempted to address these shortcomings by attaching grappling devices to front-end loader buckets. Such grapple systems typically include an upper, movable jaw member that pivots about a horizontal axis between open and closed positions relative to the fixed bucket. The movable jaw member opens and closes to secure the load within the mouth of the bucket. Once securely pinned within or against the opening of the bucket, the load may be lifted and carried to the desired location. This improvement helped to lift and carry some large and awkward materials with the bucket. However, both the buckets and the grappling arms created physical and visual obstructions to the desired operation of the attachment. Regardless of their position, the bucket and grapple devices commonly interfered with the operator's view of the subject materials to be hauled and the bucket remained ineffective for piercing through solid ground cover.

Another shortcoming of the bucket-grapple attachment involves the limited linkage and actuation configuration of the jaw member. For example, there are certain orientations of the device which will render the actuating mechanism with a relatively short effective lever arm, providing little, if any, mechanical advantage. Accordingly, large actuators and heavy structural supports are frequently required to provide a broad range of grapple jaw movement.

A number of "pure grapple" attachments have been developed for unearthing, lifting and carrying large, awkward materials. U.S. Pat. No 6,098,320 teaches a grapple attachment comprising an upper jaw, having a plurality of grapples, that is pivotally mounted to the exterior of a tine frame which houses a plurality of elongated tines. The tine frame is connected to a mounting frame which is operatively coupled to the front of an end loader. The tines extend vertically through the tine frame so that they can be used to pierce the ground adjacent a partially buried rock. The upper jaw is pivoted toward and away from the tines by an actuator. This action enables the upper jaw and the tines to work together to extract the rock from the ground. However, while the fixed vertical position of the tines is helpful for piercing the ground cover, it is poorly suited for extending beneath planar and/or elongated materials such as concrete slabs or a plurality of logs. To lift and carry such materials, the attachment must rely on the pressure exerted by the upper jaw and actuator in pinning the materials between the upper jaw and the tines in an action not unlike a pair of tweezers. Thus, the attachment's ability to lift and carry large planar objects is limited by the power of the actuator, the length of the grapples and tines and the size of the opening between the outward ends of the grapples and the tines. As any of these factors decreases, so does the lifting and carrying power of the grapple.

Other "pure grapples" known in the art, which are better suited for lifting and carrying planar and/or elongated materials, teach the use of multiple actuators, pivot and extension arms or complex geometries and linkages. Such attachments are complex, expensive and difficult to manufacture. Accordingly, there is a need for an improved grapple attachment for front end loaders and other vehicles that is simple, but capable of piercing solid ground cover and hauling large, planar and/or elongated materials.

SUMMARY OF THE INVENTION

The present invention relates to a grapple attachment for front-end loaders and other vehicles. The grapple is comprised of upper and lower jaws, each having a plurality of elongated, generally angular tines. The upper and lower jaws are pivotally connected to each other at the rearward ends thereof and pivotally connected to the front-end loader. A single actuator moves the jaws between open and closed positions. A first end of the actuator is pivotally connected to the upper jaw and the second end of the actuator is operatively connected to the front-end loader and the operational controls thereof.

In operation, the grapple of the present invention is used to dislodge, lift and carry large planar and irregularly shaped materials. The grapple is particularly well suited for construction and agricultural operations ranging from the removal of brush and fallen trees to the dislodging, lifting and transporting of concrete slab. The lower jaw of the grapple is adapted to first pierce the concrete slab. The lower jaw can then be angled and driven beneath the concrete. The angular shape of the lower jaw allows it to place a substantial portion of its elongated upper surface closely adjacent the lower surface of the concrete. The actuator then closes the grapple so that the upper jaw engages the upper surface of the concrete. The front-end loader may then raise the grapple and transport the concrete slab to a desired location.

The grapple can be manufactured from high-tension steel for strength and durability. However, the simple geometry and construction of the grapple make it inexpensive and easy to manufacture. Its use of a standardized front-end loader hitch makes the grapple versatile for quick and easy assembly on a plurality of vehicle types.

It is therefore an object of the invention to provide an improved grapple attachment that is easy to manufacture and use on different types of front-end loaders and related vehicles.

A further object of the invention is to provide an improved grapple attachment having an upper jaw and a lower jaw that are pivotally connected to one another and capable of being pivoted in open and closed positions.

A further object of the invention is to provide an improved grapple attachment having an upper jaw and a lower jaw that are pivoted into open and closed engagement with one another by means of a single actuator.

A further object of the invention is to provide an improved grapple attachment capable of piercing solid ground cover and then lifting whole, planar sections thereof.

A further object of the invention is to provide an improved grapple attachment that is adapted to dislodge, lift and transport a plurality of materials such as brush, logs, rocks and slabs of concrete quickly and efficiently.

These and other objects of the present invention will be apparent to those skilled in the art.

DESCRIPTION OF THE PREFERRED EMBODIMENT

Figure 1:
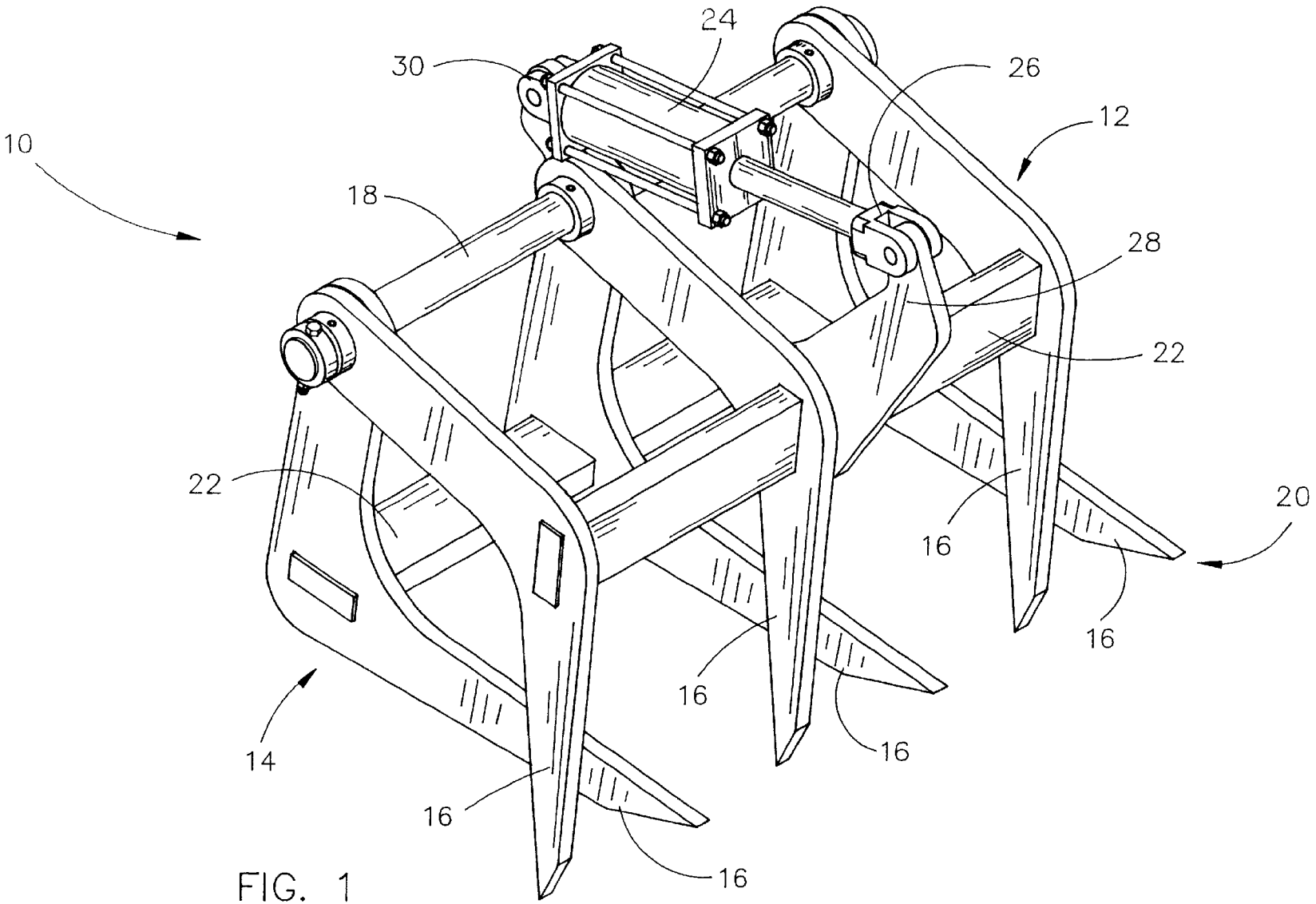
FIG. 1 is a perspective view of the grapple attachment of the present invention.

The numeral 10 refers generally to the grapple attachment of the present invention as the same is depicted in FIGS. 1–4. It will be apparent to those skilled in the art that the grapple of the present invention is well suited for a plurality of tasks including the dislodging, lifting and transporting of whole slabs of concrete, logs, rocks and other awkwardly shaped debris. It should also be understood that the grapple is easily adapted for use as an attachment for a plurality of motorized vehicles, including front-end loaders, skid loaders, tractors, backhoes, excavators and end loaders. However, the examples described herein should not be considered to be limiting, as the uses and applications of the present invention are limited only by the imagination of the user. For simplicity of description, the grapple attachment of the present invention will be described as it is used on skid loaders in the construction industry for excavating, lifting and moving slabs of concrete.

As shown in FIGS. 1–4, the grapple 10 is comprised of an angular upper jaw 12 and an angular lower jaw 14, each having rearward and forward ends. Upper jaw 12 and lower jaw 14 are each comprised of a plurality of individual, generally elongated tines 16 having first and second ends. The tines 16 are generally L-shaped, each having substantially flat upper and lower surfaces. The tines of upper jaw 12 are shaped such that they have an angle, intermediate the first and second ends, greater than ninety degrees. The tines of lower jaw 14 are shaped such that they have an angle, intermediate the first and second ends, less than ninety degrees. It is contemplated, however, that the angles at which the tines 16 are disposed could be varied greatly to accommodate specific design needs.

Figure 4:
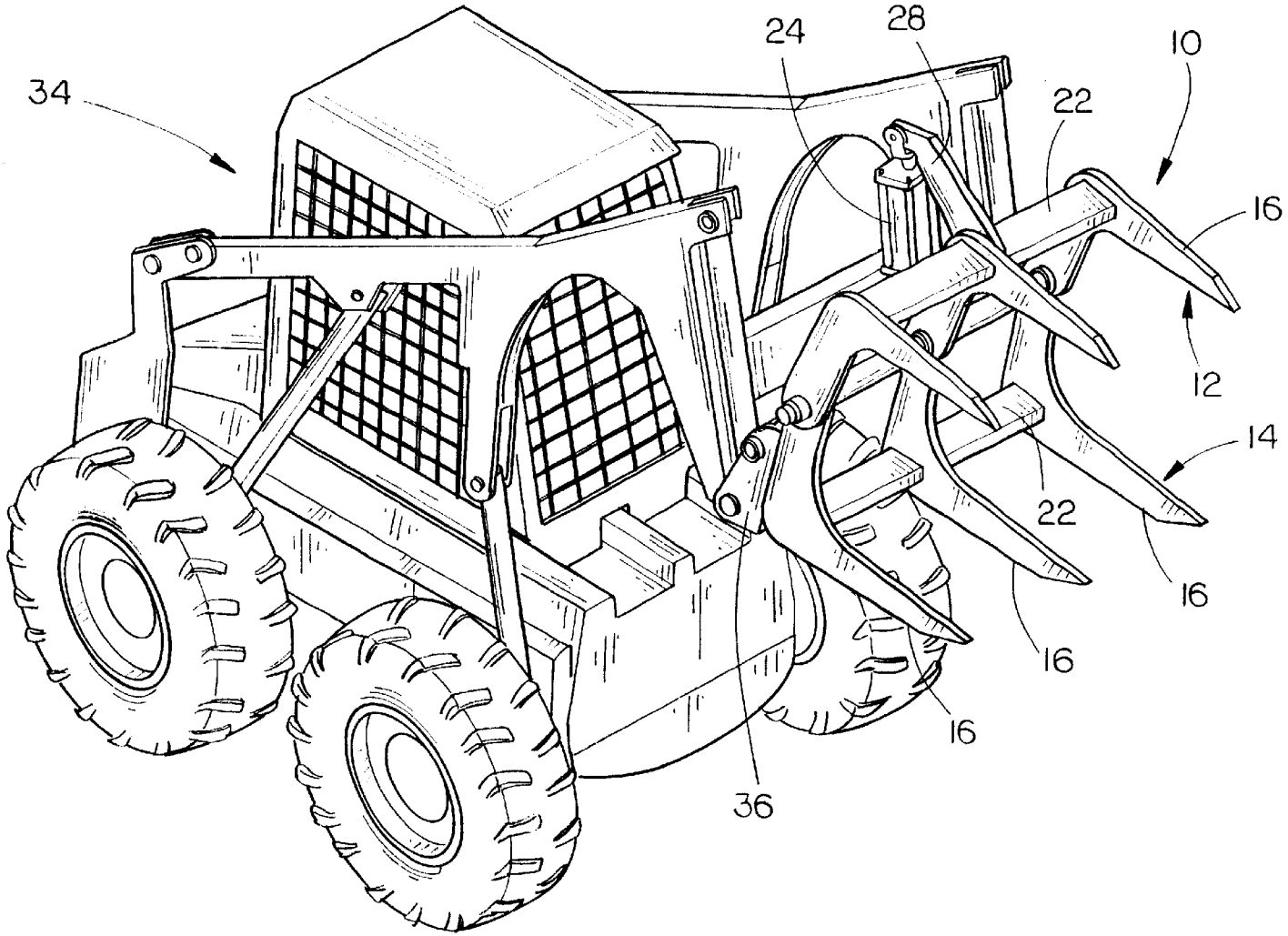
FIG. 4 depicts the grapple attachment of the present invention as it is operatively connected to a front-end loader.

The upper and lower jaws are pivotally connected to each other at the rearward ends thereof. Accordingly, each of the tines 16 are provided with first openings disposed closely adjacent the second ends thereof. The first openings are adapted to receive a pivot pin 18 which extends therethrough in a generally horizontal manner. The tines 16 of upper jaw 12 and lower jaw 14 are horizontally spaced from one another to accommodate the desired number of tines 16, as depicted in FIGS. 1 and 4. While it is preferred to use three tines 16 on each of the upper jaw 12 and lower jaw 14, it is contemplated that more or fewer tines 16 could be used. While fewer tines 16 in lower jaw 14 may equate to a reduced surface in which to carry materials having smaller cross sections, fewer tines 16 in lower jaw 14 increase the ability of lower jaw 14 to pierce hard ground coverings including concrete and asphalt. To further assist the lower jaw 14 in piercing such materials, the first ends of the tines 16 are tapered to form a piercing edge 20.

Each of the tines 16 are further provided with second openings disposed intermediate the first and second ends of the tines 16. The second openings are adapted to receive a bracing member 22, which extends therethrough in a generally horizontal manner. The tines 16 of upper jaw 12 and lower jaw 14 are secured to the bracing members 22 in spaced relation to each other, as shown in FIGS. 1 and 4. The bracing members 22 thus serve as an integral portion of the grapple frame, providing the stability required to pierce through and carry various materials.

A single actuator 24 moves the jaws between open and closed positions, as depicted in FIGS. 1–4. A first end 26 of the actuator is pivotally connected to an upper bracket 28 on upper jaw 12. The second end 30 of the actuator is connected to a second bracket 32 on lower jaw 14. Ultimately, the actuator is operatively connected to the vehicle 34 and the operational controls thereof. Although a plurality of actuators could be used, one actuator provides the present grapple with sufficient grappling power for the contemplated uses of grapple 10.

The grapple 10 is easily attached to a plurality of different motorized vehicles, including front-end loaders, skid loaders, tractors, backhoes, excavators or end loaders, by means of a mounting bracket 36. In order to attach the grapple 10 to different vehicles, it is preferred that a universal two-pin, quick-attach hitch be used for the mounting bracket 36. However, it is contemplated that other mounting assemblies would appropriately secure the grapple 10 to the vehicle 34.

The grapple 10 can be manufactured from numerous materials that are durable and have sufficient strength for the contemplated uses. The grapple 10 of the preferred embodiment uses a high-tension steel, such as ASTM-A-572 Grade 50 High Tensile Plate, or its approximate equivalent. Using the plate steel provides more than strength. The plate steel provides ease of manufacture. The tines, mounting brackets and bracing members can all be cut from a single plate of steel, without the need of further processing and manufacture, thus also decreasing the total cost of manufacture.

In operation the grapple 10 of the present invention can be used to dislodge, lift and carry large planar and irregularly shaped materials. The grapple 10 is particularly well suited for construction and agricultural operations ranging from the removal of brush and fallen trees to the dislodging, lifting and transporting of concrete slab. For example, the operator can position the lower jaw 14 of the grapple 10 closely adjacent the surface of a section of concrete. The general geometry of the tines 16 enable them to first pierce the concrete slab and then be angled such that they can be positioned closely adjacent the lower surface of the concrete slab. The angular shape of the lower jaw 14 allows it to place a substantial portion of its elongated upper surface closely along the planar surface of the concrete. The actuator 24 then closes the grapple so that the upper jaw 12 engages the upper surface of the concrete. The vehicle 34 may then raise the grapple 10 and transport the concrete slab to a desired location.

Figure 3:
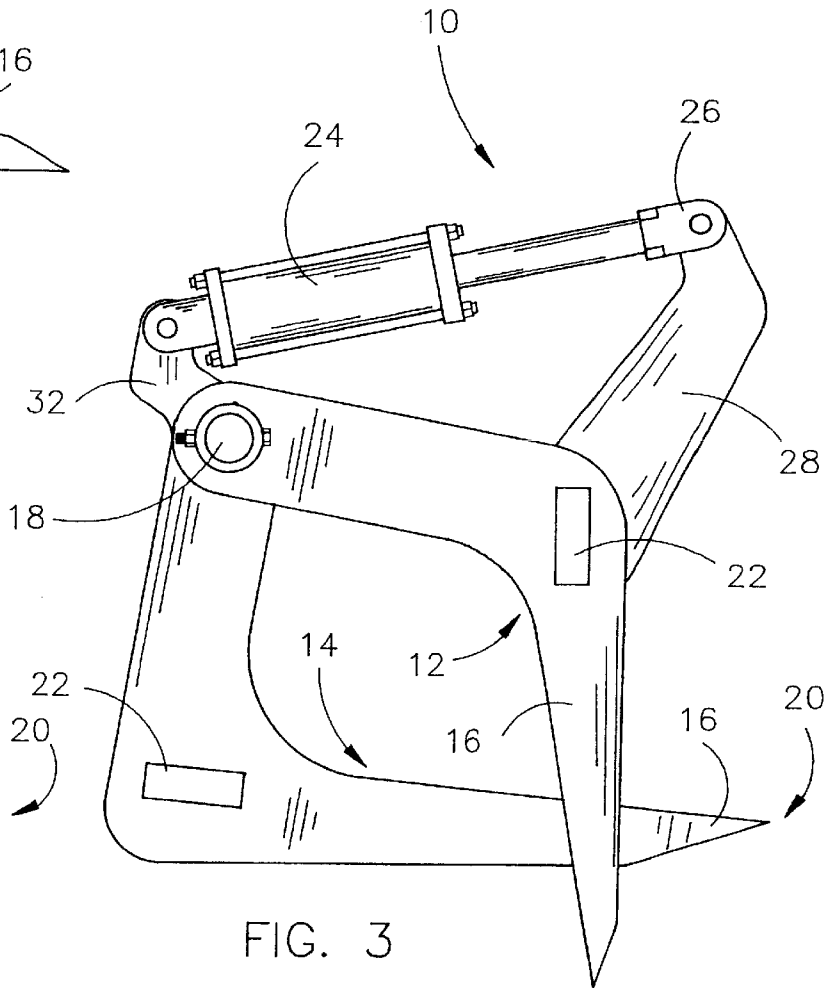
FIG. 3 is a side view of the grapple attachment of the present invention in its closed position.
Figure 2:
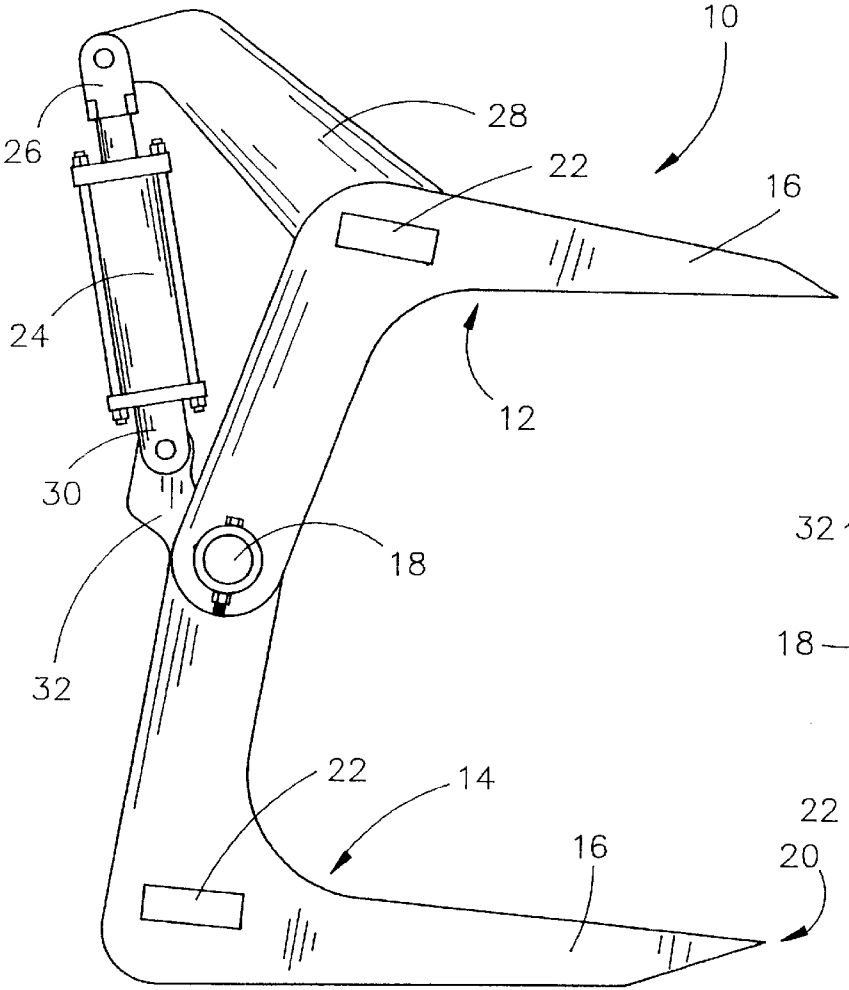
FIG. 2 is a side view of the grapple attachment of the present invention in its open position.

The generally angular, or L-shaped, geometry of the tines 16 provides a number of additional functional benefits over prior art grapples. The tines 16 of the upper jaw 12 and lower jaw 14 are secured to pivot pin 18 and bracing members 22 such that when the grapple 10 moves into the closed position depicted in FIGS. 1 and 3, the first ends of the tines 16 in the upper jaw 12 move past the tines 16 of the lower jaw 14, crossing closely adjacent thereto. This ability of the upper and lower jaws to mesh partially through one another enables the grapple 10 to crush and compact materials such as scrap iron, brush and other debris. Furthermore, the angular geometry of the tines 16, in combination with the force applied by the actuator 24, enables grapple 10 to lift objects weighing as much or more than the rated operating capacity for the vehicle 34 when the forward ends of the upper and lower jaws are closely adjacent one another in a "Tweezing" position. Similarly, the first ends of the tines 16 comprising the upper and lower jaws intersect at an angle that enables the grapple 10 to be used to remove elongated, vertically disposed posts positioned partially below ground. Finally, when the first ends of the tines 16 are intermeshed, as depicted in FIGS. 1 and 3, the grapple 10 can be lowered to engage the cutting surfaces 20 of the tines 16 comprising upper jaw 12 with the surface of the ground. The vehicle 34 can then be operated in a rearward direction to scarify the ground cover. Similarly, the grapple 10 can be placed in the open position to engage the cutting surfaces 20 of the tines 16 comprising lower jaw 14 with the surface of the ground. The vehicle 34 can be operated in a forward direction for ripping the surface of the ground. These additional functions replace the operation of several different attachments, thus increasing the productivity of the grapple-vehicle combination.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. In combination:

a motorized vehicle; and a grapple, comprising:

an upper jaw comprising a plurality of upper jaw tines having first and second end portions extending substantially perpendicularly from one another; said upper jaw tines being horizontally spaced from one another with the spaces between the upper jaw tines being substantially open;

a lower jaw comprising a plurality of lower jaw tines having first and second end portions extending substantially perpendicularly from one another; said lower jaw tines being horizontally spaced from one another with the spaces between the lower jaw tines being substantially open and U-shaped;

a plurality of elongated bracing members for securing the tines of said upper and lower jaws in horizontally spaced relation to one another intermediate the first and second end portions of said upper and lower jaw tines; said upper and lower jaw tines each having an opening disposed therethrough, intermediate the first and second end portions of said upper and lower jaw tines; said openings being adapted to receive said bracing members;

said second end portion of said at least one upper jaw tine being operatively coupled to said second end portions of said lower jaw tines along a common, generally horizontal axis, enabling said upper and lower jaws to be pivoted about said generally horizontal axis between open and closed positions;

a mounting bracket operatively mounting said grapple on said motorized vehicle; and at least one single actuator, operatively connected to said upper jaw, for selectively moving the grapple into said open and closed positions.

2. The combination of claim 1 wherein said motorized vehicle is one of a front-end loader, skid loader, tractor, backhoe, excavator or end loader.

3. The combination of claim 1 wherein said mounting bracket is a two-pin, quick-attach hitch.

4. The combination of claim 1 wherein said actuator is comprised of a hydraulic piston and bracket assembly.

5. The combination of claim 1 wherein said upper and lower jaws are comprised of a solid, high-strength steel plate.

6. The combination of claim 1 wherein said lower jaw is provided with a cutting surface to pierce solid ground cover; said lower and upper jaws being shaped to lift whole, planar sections of the solid ground cover.

7. The combination of claim 1 wherein said grapple is shaped to dislodge and selectively lift elongated substantially vertically disposed posts.

8. A method for providing a grapple attachment for a motorized vehicle, comprising the steps of:

providing a plurality of substantially L-shaped tines, having first and second ends;

forming a first opening in each of said L-shaped tines, closely adjacent the second ends thereof; said openings being adapted to receive a pivot pin;

providing a generally elongated and cylindrical pivot pin;

providing an actuator having first and second ends;

providing a mounting bracket for operatively mounting the grapple to said motorized vehicle;

providing a plurality of elongated bracing members;

forming a second opening in each of the L-shaped tines, intermediate the first and second ends of the L-shaped tines; said second openings being adapted to receive said bracing members;

operatively coupling said L-shaped tines to the pivot pin to form a grapple, such that at least one of said L-shaped tines forms an upper grapple jaw and a plurality of said L-shaped tines form a lower grapple jaw; said upper and lower grapple jaws being selectively pivotable about said pivot pin between an open position or closed position;

operatively connecting the first end of said actuator to said upper grapple jaw; and operatively connecting said mounting bracket to said grapple.

9. The method of claim 8 further comprising the step of securing at least one of said elongated bracing members within the second openings of the L-shaped tines of said upper grapple jaw and securing at least one of said elongated bracing members within the second openings of the L-shaped tines of said lower grapple jaw so that said L-shaped tines are joined together in spaced relation along the length of said elongated bracing members.

10. The method of claim 9 further comprising the step of cutting said tines of said upper and lower grapple jaws and said bracing member from at least one sheet of high-strength steel.

11. The method of claim 10 further comprising the steps of forming at least one cutting surface on the lower grapple jaw to pierce solid ground cover and shaping said lower and upper jaws to lift whole, planar sections of the ground cover with respect to the ground.

12. The method of claim 10 further comprising the step of shaping the lower grapple jaw so that it can be used to selectively dislodge and lift substantially vertically disposed elongated posts.

* * * * *